US008153919B2

(12) United States Patent
Inoue et al.

(10) Patent No.: US 8,153,919 B2
(45) Date of Patent: Apr. 10, 2012

(54) DOME SHEET UNIT AND MEMBRANE SWITCH HAVING THE SAME

(75) Inventors: Tsuyoshi Inoue, Tokyo (JP); Shintaro Ogura, Tokyo (JP); Katsutoshi Shinagawa, Tokyo (JP)

(73) Assignee: Mitsumi Electric Co., Ltd, Tokyo (JP)

( * ) Notice: Subject to any disclaimer, the term of this patent is extended or adjusted under 35 U.S.C. 154(b) by 274 days.

(21) Appl. No.: 12/588,032

(22) Filed: Oct. 1, 2009

(65) Prior Publication Data

US 2010/0126841 A1 May 27, 2010

(30) Foreign Application Priority Data

Nov. 27, 2008 (JP) ..... 2008-303032

(51) Int. Cl.
*H01H 5/30* (2006.01)

(52) U.S. Cl. ..... 200/406; 200/516

(58) Field of Classification Search ..... 200/406, 200/516; 341/22; 345/168, 169
See application file for complete search history.

(56) References Cited

U.S. PATENT DOCUMENTS 5,136,131 A * 8/1992 Komaki ..... 200/516
6,548,779 B2 * 4/2003 Takahashi et al. ..... 200/516
6,593,537 B2 * 7/2003 Teruyama et al. ..... 200/515
6,768,074 B2 * 7/2004 Iwama ..... 200/515
6,909,063 B2 * 6/2005 Nam ..... 200/406
7,960,663 B2 * 6/2011 Yoshihiro ..... 200/310

FOREIGN PATENT DOCUMENTS

JP 2003-100170 A 4/2003

* cited by examiner

*Primary Examiner* — Michael Friedhofer
(74) *Attorney, Agent, or Firm* — Washida & Associates

(57) ABSTRACT

A membrane switch can attach an elastically deformable dome to a board in a reliable manner such that the dome is not detached even if a fixing sheet is made thinner and smaller and therefore has a smaller footprint. This switch has: a dome (110) that is formed projecting toward the surface and that is dented opposite toward the back surface by elastic deformation; and a flexible fixing sheet (120) that has a back surface of an adhesive face pasted to the entire face of the surface of the dome (110). The fixing sheet (120) fixes the dome (110) in a predetermined position of a board (4) by means of a stretching part (122) which stretches radially outer to the dome (110), from an outer rim (112) of the dome (110), in a direction virtually orthogonal to a direction in which the dome (110) projects. A plurality of slits (130) formed in the fixing sheet (120) at predetermined intervals along the outer rim (112) of the dome (110), prevent a stretching part (122) of the fixing sheet (120), from joining with a dome covering part (121) which is a portion above the dome (110) that continues in the radial direction of the dome (110).

3 Claims, 5 Drawing Sheets

DOME SHEET UNIT AND MEMBRANE SWITCH HAVING THE SAME

CROSS REFERENCE TO RELATED APPLICATIONS

The disclosure of Japanese Patent Application No. 2008-303032, filed on Nov. 27, 2008, including the specification, drawings and abstract is incorporated herein by reference in its entirety.

TECHNICAL FIELD

The present invention relates to a dome sheet unit with a metal dome that is provided between a fixed contact point and a key pushing element and that forms a movable contact point, which is pressed by the pushing element and contacts the fixed contact point, and relates to a membrane switch having this dome sheet unit.

BACKGROUND ART

Conventionally, an operation key unit mounted on mobile terminals such as mobile telephones is made thin by utilizing membrane switches with metal domes, on a switch printed circuit board arranged on the back side of the operation key top.

As disclosed in Patent Literature 1, a membrane switch has: a metal dome, which serves as a movable contact point that is provided under a pushing element provided on the back face of the key top exposed in the surface of the casing, and that deforms by being pressed by the pushing element; and a fixed contact point that is provided below the metal dome.

To be more specific, on the switch printed circuit board, a circular, fixed contact point that is positioned right below the key top is provided; and, to encircle this fixed contact point, a fixed contact point that is annular concentric with the circular fixed contact point is provided. The metal dome makes its top part face the circular fixed contact point at a predetermined interval and places its peripheral part in a position to abut on the annular fixed contact point, so that the metal dome is fixed by an insulating fixing sheet and prevented from being displaced or detached.

FIG. 1 shows a structure of a conventional membrane switch using a metal dome. In FIG. 1, the circular fixed contact point and annular fixed contact point on the board are omitted.

With conventional membrane switch 1 shown in FIG. 1, metal dome 2 is fixed to board 4 by being covered by fixing sheet 3 from the surface side, such that metal dome 2 is not displaced from a predetermined position.

Citation List

Patent Literature

PTL 1: Patent 2003-100170

SUMMARY OF INVENTION

Technical Problem

According to the conventional membrane switch structure using a metal dome, fixing sheet 3 is pasted over board upper face 4*a* that is virtually horizontal and metal dome 2 that projects upward from board upper face 4*a* and that has convex surface 2*a*. Therefore, force to pull metal dome 2 in the projecting direction of the metal dome and lift metal dome 2 from the upper face of the board, applies to the portion X near the outer rim of metal dome 2. In this way, the portion X near the outer rim of metal dome 2 below fixing sheet 3 is not pasted to surface 4*a* of board 4, and a gap is created between fixing sheet 3 and surface 4*a* of board 4 right below fixing sheet 3.

Therefore, if the miniaturization of membrane switches causes the miniaturization of metal domes and, as a result of this, fixing sheet 3 is made smaller, the area of the part in fixing sheet 3 that is positioned around metal dome 2 and that is pasted to board upper face 4*a* becomes smaller, and fixing sheet 3 is easily peeled off, and therefore there is a problem that the metal dome is more easily be displaced or detached from a predetermined position.

It is therefore an object of the present invention to provide a dome sheet unit that can attach an elastically deformable dome to a board in a reliable manner such that the dome is not detached even if a fixing sheet is made thinner and smaller and therefore has a smaller footprint, and a membrane switch having this dome sheet unit.

Solution to Problem

To achieve the above object, the present invention employs a configuration which includes: a dome that in a regular state projects toward a surface and that is dented opposite toward a back surface by elastic deformation; and a fixing sheet that is flexible, that has a back face of an adhesive face pasted to an entire surface of the surface of the dome and that fixes the dome in a predetermined position by means of a stretching part which stretches radially outer to the dome, from an outer rim of the dome, in a direction substantially orthogonal to a direction in which the dome projects, and in which wherein a plurality of cut parts formed in the fixing sheet at predetermined intervals along the outer rim of the dome, prevent the stretching part in the fixing sheet, from joining with a part above the dome which continues in a radial direction of the dome.

ADVANTAGEOUS EFFECTS OF INVENTION

The present invention can attach an elastically deformable dome to a board in a reliable manner such that the dome is not detached even if a fixing sheet is made thinner and smaller and therefore has a smaller footprint.

DESCRIPTION OF EMBODIMENTS

Hereinafter, an embodiment of the present invention will be explained in detail with reference to the accompanying drawings.

Figure 1:
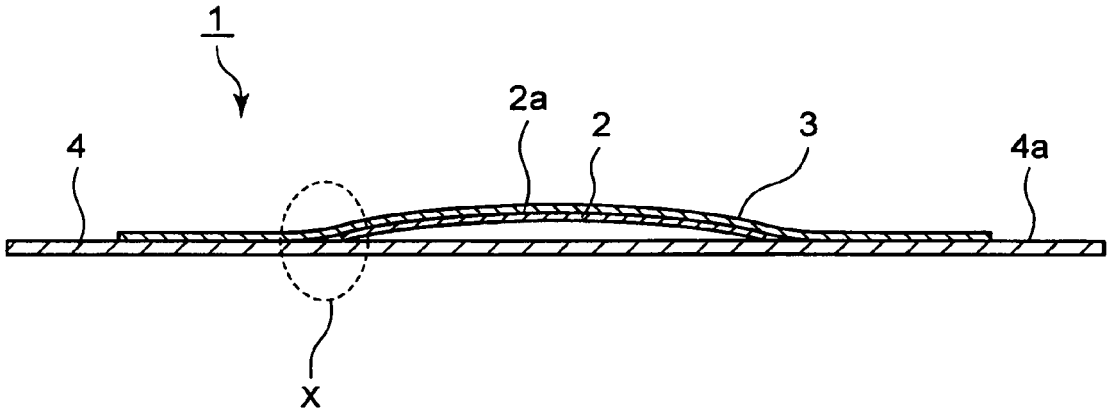
FIG. 1 shows a metal dome attachment structure in a conventional membrane switch.
Figure 2:
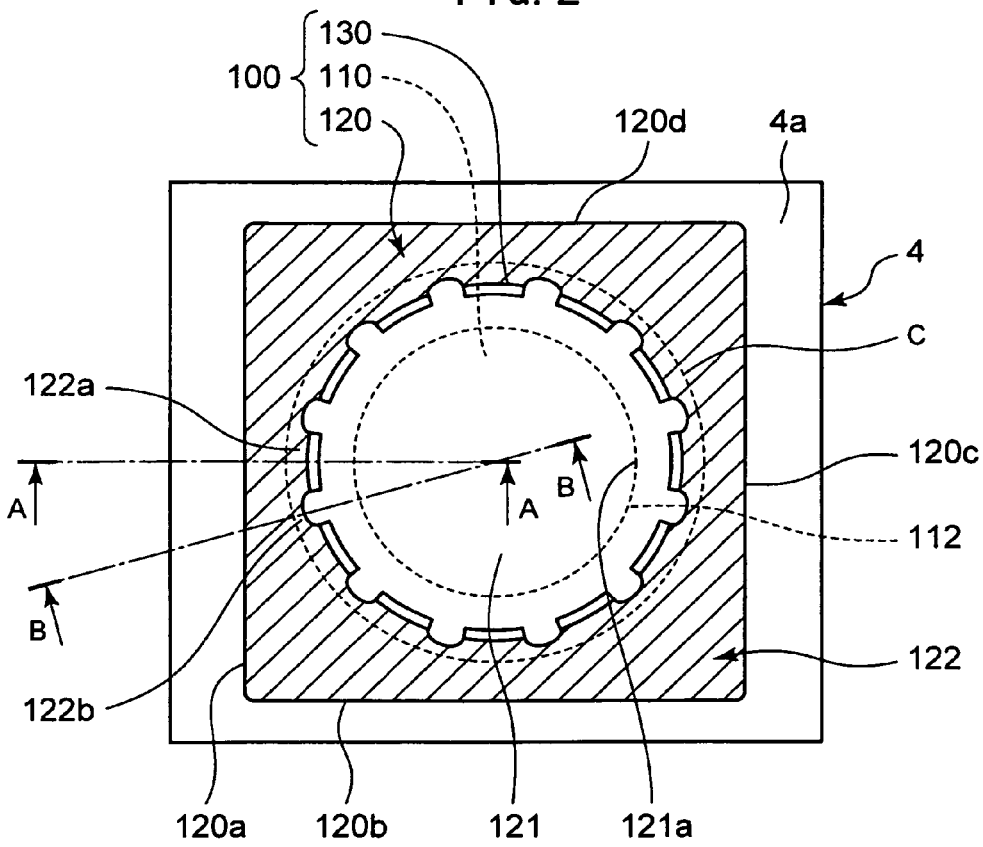
FIG. 2 is a plan view of a dome sheet unit according to an embodiment of the present invention.
Figure 3:
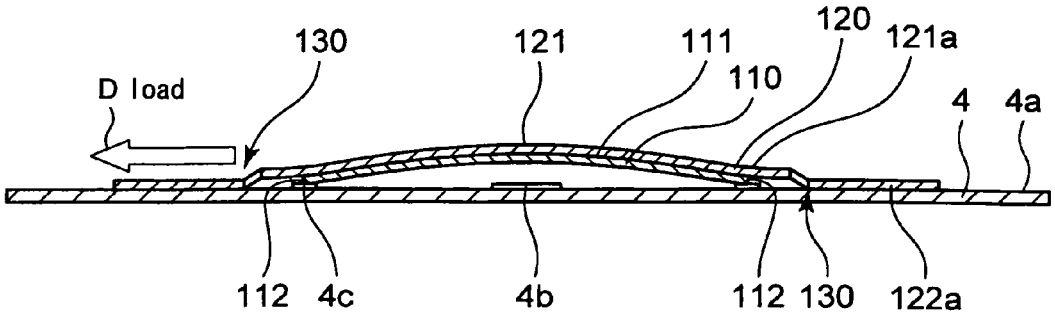
FIG. 3 is a cross-sectional view showing the configuration of main parts of the dome sheet unit according to an embodiment of the present invention.

FIG. 2 is a plan view showing the configuration of main parts of dome sheet unit 100 according to an embodiment of the present invention, and FIG. 3 is a cross-sectional view showing the configuration of main parts of dome sheet unit 100 according to an embodiment of the present invention.

Dome sheet unit 100 is mounted on board 4 (i.e. flexible board) provided below the operation keys in a mobile terminal such as a mobile telephone and portable music player, and forms a membrane switch together with fixed contact point 4*b* mounted on upper face 4*a* of board 4.

As shown in FIG. 2 and FIG. 3, dome sheet unit 100 has: flexible, electrically conductive dome 110; and fixing sheet 120 that is pasted to dome 110 and attached to the board (which is the attachment face) on which dome 110 is mounted.

Dome 110, which in the regular state projects toward surface (i.e. outer face) 111, and which is dented opposite toward the back surface (i.e. inner face) by elastic deformation, is dented by being pressed from above and is restored to the original shape after the pressing is released.

This dome 110 is fixed to board 4 by fixing sheet 120 that is pasted to the entire face of surface 111. In dome 110 attached to board 4 by fixing sheet 120, the center portion of dome 110 is located right above fixed contact point 4*b* mounted on board 4, spaced apart from fixed contact point 4*b*, and the lower end of dome 110 is provided in contact with annular fixed contact point 4*c* that is concentric with fixed contact point 4*b* and that is placed apart from fixed contact point 4*b*.

Dome 110 is dented opposite by being pressed from above and contacts and electrically connects with fixed contact point 4*b* on board 4. When the pressure is released, dome 110 moves away from fixed contact point 4*b* and is electrically disconnected with fixed contact point 4*b*. Although a metal dome that is formed in a circular shape from a plan view is used as dome 110, the present invention is not limited to this, and dome 110 may be formed in any shape as long as dome 110 is dented opposite inwardly by elastic deformation. For example, dome 110 may be configured by mixing carbon and so on in, for example, rubber, such that dome 110 projects toward the surface and is dented inwardly by elastic deformation. Further, fixed contact point 4*b* and annular contact point 4*c* may be wired in any way on board 4 as long as they are configured to be electrically connected when dome 110 is dented by deformation.

Fixing sheet 120 is thin, flexible and planar, and is made of, for example, polyethylene and polyimide. The back face of fixing sheet 120 is configured as an adhesive face by, for example, applying an adhesive that functions as a glue.

The back side of fixing sheet 120 is pasted to the entire face of semi-spherical surface 111 of dome 110, such that the peripheral part (corresponding to stretching part 122) of fixing sheet 120 is attached to stretch radially outer to dome 110, from outer rim 112 of dome 110. Further, the radial direction here refers to the direction orthogonal to the projecting direction of dome 110, and means the radial direction of the circle defined by the lower end of dome 110.

That is, fixing sheet 120 is pasted over the entire face of the projecting surface of dome 110 and surface 4*a* of board 4 that is positioned around dome 110. To be more specific, fixing sheet 120 fixes dome 110 to board 4 by stretching outer rim 112 of dome 110 from the part covering outer rim 112 of dome 110 (i.e. dome covering part 121), toward the radially outside which is virtually orthogonal to the projecting direction of dome 110, and by gluing stretching part 122, the entire back face of which is an adhesive face, to board 4 by surface contact.

Here, fixing sheet 120 is formed in a rectangular shape from a plan view. With stretching part 122 of fixing sheet 120, seen from a plan view, the pasting area of the potion in the radially inside from the center portion of side parts 120*a* to 120*d* that define the outer rim of fixing sheet 120, is smaller than the pasting area of the corner parts surrounded by side parts 120*a* to 120*d* that are orthogonal to each other. Here, the ratio of the diameter of dome 110 to the length of one side of fixing sheet 120, is 3:3.5. For example, if the diameter of dome 110 is 3 millimeters, the projection length of dome 110 is about 0.2 millimeters and the length of one side of square fixing sheet 120 from a plan view is 3.5 millimeters.

A plurality of slits (i.e. cut parts) 130 are formed in stretching part 122 of fixing sheet 120, at predetermined intervals along outer rim 112 of dome 110.

With fixing sheet 120, slits 130 are provided on surface 111 of dome 110 to prevent outer rim part 121*a* of dome covering part 121 that covers dome 110, from joining with stretching parts 122*a* of stretching part 122 positioned in the radially outside of outer rim part 121*a* of dome covering part 121. In the radially outside, these stretching parts 122*a* of stretching part 122 are adjacent to slits 130, and will be referred to as "outer adjacent parts 122*a*" below for ease of explanation.

Slits 130 are formed near outer rim 112 of dome 110. Here, in fixing sheet 120, slits 130 are formed in positions 0.5 millimeters away from outer rim 112 of dome 110.

Here, in fixing sheet 120, slits 130 have arc shapes formed around dome 110, at equal intervals along outer rim 112 of dome 110. Preferably, the portions between the slits are positioned in symmetry with respect to the center of dome 110. A plurality of slits 130 are formed in fixing sheet 120 such that the portions between adjacent slits 130 along the outer rim of dome 110 are glued to board 4 to prevent dome 110 from moving in the horizontal direction.

The widths of slits 130 are preferably narrowed as much as possible to secure a wide gluing area in stretching part 122 in which the gluing area (i.e. pasting area) is limited, and slits 130 may be formed by cuts like a line. Here, slits 130 are formed by processing fixing sheet 120 pasting its back face to dome 110, and have the width of 0.15 millimeters.

As described above, with dome sheet unit 100 according to the present embodiment, in fixing sheet 120 that covers dome 110, a plurality of slits 130 are formed along the outer periphery of dome 110 to prevent outer rim part 121 a of dome covering part 121 that covers dome 110, from joining with outer adjacent parts 122*a* of stretching part 122 that are positioned in the radially outside of outer rim part 121 a of dome covering part 121.

Therefore, when the back face of stretching part 122 is pasted to board 4 to attach dome sheet 100 to board 4, in stretching part 122 that contacts board 4 by surface contact, outer adjacent parts 122*a* that, in the radially outside, are adjacent to slits 130 near dome 110, are not pulled by dome covering part 121 attached to surface 111 of dome 110 that projects upward from board 4 and lifted from board 4.

That is, in a state where dome sheet unit 100 is attached to board 4, in fixing sheet 120, dome covering part 121 that changes the shape to match the shape of spherical surface 111 of dome 110 which projects from board 4, applies tensile strength that is the force in the projecting direction of dome 110 in which dome 110 is pulled and lifted, to outer adjacent parts 122*a* of stretching part 122.

However, with dome sheet unit 100 of the present embodiment, slits 130 formed along outer rim 112 of dome 110 block the tensile strength by dome covering part 121 before the tensile strength is applied to outer adjacent parts 122*a* positioned in the radially outside of dome covering part 121.

Figure 4A:
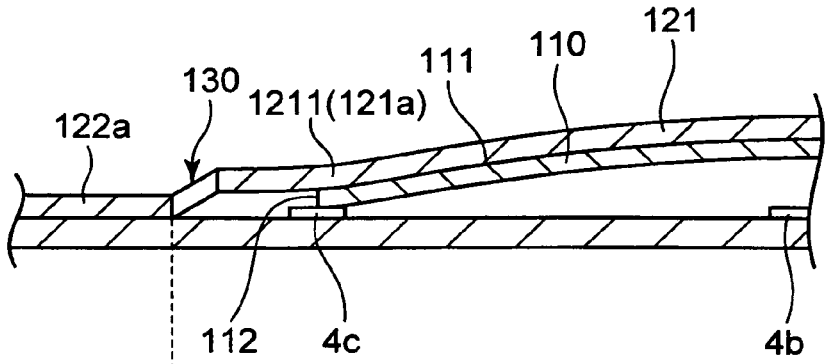
FIG. 4 is a magnified cross-sectional view showing the configuration of main parts of the dome sheet unit according to an embodiment of the present invention.
Figure 4B:
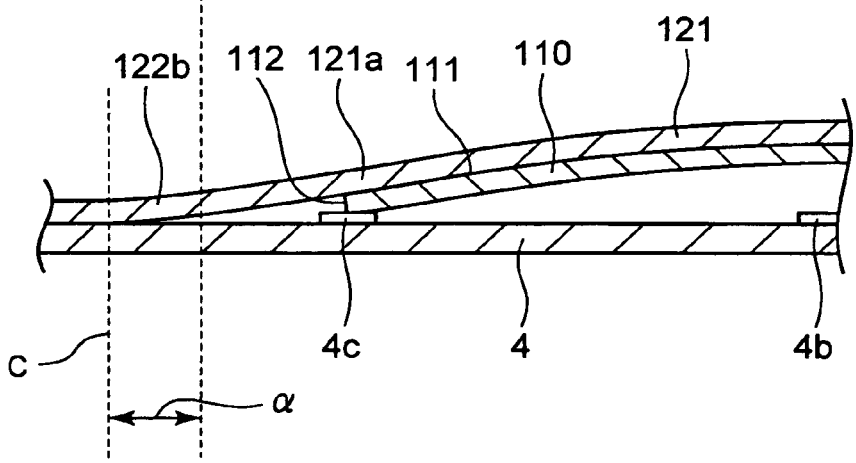

FIG. 4 shows the configuration of main parts of dome sheet unit 100 according to an embodiment of the present invention, FIG. 4A is a cross-sectional view seen from the A-A line of FIG. 2 and FIG. 4B is a cross-sectional view seen from the B-B line of FIG. 2.

As shown in FIG. 4A, outer adjacent parts 122*a* of stretching part 122 that are adjacent to slits 130 in the radially outside are prevented by slits 130 from, in the radial direction (i.e. the direction that is virtually orthogonal to the projecting direction of dome 110), joining with part 1211 of outer rim part 121*a* of dome covering part 121 positioned in the radially inside of outer adjacent parts 122*a*. Therefore, as shown in FIG. 4A, the tensile strength that is the force in the projecting direction of dome 110 in which dome 110 is lifted, applies up to the portion in the radially inside before slits 130 of fixing sheet 120 including part 1211, and consequently outer adjacent parts 122*a* are kept closely attached to board 4.

By this means, the tensile strength does not apply to outer adjacent parts 122*a*, and outer adjacent parts 122*a* are not lifted even if time passes. Accordingly, the area of outer adjacent parts 122*a* contacting board 4 does not decrease due to the tensile strength.

By contrast with this, in stretching part 122 as shown in FIG. 4B, the tensile strength applies to the portion that is not adjacent to slits 130. That is, the tensile strength applies to part 122*b* that continues to outer rim part 121*a* of dome covering part 121 in the radial outside.

As described above, in stretching part 122, parts (i.e. outer adjacent parts 122*a*) where slits 130 are formed in the radially inside shown in FIG. 4A, abut on board 4 without the tensile strength from the radially inside. In this way, outer adjacent parts 122*a* secure a gluing area (i.e. pasting area) corresponding to area a, compared to the portion of stretching part 122 without slits in the radially inside (i.e. part 122*b* joining with outer rim part 121*a* shown in FIG. 4B). By this means, according to the present embodiment, when the space in board 4 where dome sheet unit 100 is attached is narrow and small and the area of stretching part 122 contacting board 4 is small, a sufficient contact area is secured without reducing the area of stretching part 122 contacting board 4.

For example, in case of a configuration without slits 130 in dome sheet unit 100, fixing sheet 120 of this configuration is lifted from board 4 in the portion between the vicinity of outer rim 112 of dome 110 and the range shown by broken line C of FIG. 2 (corresponding to the portion between the portion covering area a of FIG. 4B and covering outer rim 112, and the portion up to broken line C).

However, the configuration of dome sheet unit 100 according to the present invention makes it possible to closely attach outer adjacent parts 122*a*, which are provided in the radially outside of slits 130, to board 4 inside the area shown by broken line C. That is, compared to the configuration without slits 130, the configuration of dome sheet unit 100 makes it possible to secure the area corresponding to area a gluing to board 4. In this way, fixing sheet 120 is glued to board 4 in the area shown by hatching in FIG. 2.

As described above, dome sheet unit 100 according to the present embodiment enhances the adhesion against the load that peels off dome 110 in the vertical direction, by increasing the gluing area in stretching part 122 compared to a conventional dome sheet unit, enhances the adhesion of stretching part 122 to board 4 against the load that moves dome 110 in the horizontal direction, by alleviating the load by means of slits 130 before the load applies to stretching part 122 (to be more specific, outer adjacent parts 122*a*).

In case where the load that peels off dome sheet unit 100 in the vertical direction with respect to board 4 is applied, dome sheet unit 100 according to the present embodiment shows strength about 2.6 times to 3 times greater (i.e. peel strength) than the conventional configuration without slits. In case where the load that peels off dome sheet unit 100 in the horizontal direction with respect to board 4 (i.e. the direction indicated by arrow D of FIG. 3) is applied, dome sheet unit 100 shows the peel strength about 1.4 times to about 2 times greater than the conventional configuration without slits.

Consequently, even when a membrane switch using the dome sheet unit is miniaturized, and, as a result of this, dome sheet unit 100 has a smaller footprint and stretching part 122 of fixing sheet 120 has a smaller area according to the miniaturized dome shape, it is possible to adequately attach dome sheet unit 100 to board 4, without changing the material of the glue for attaching dome sheet unit 100 to board 4 such that the dome is not detached upward from the fixed contact point.

Figure 5:
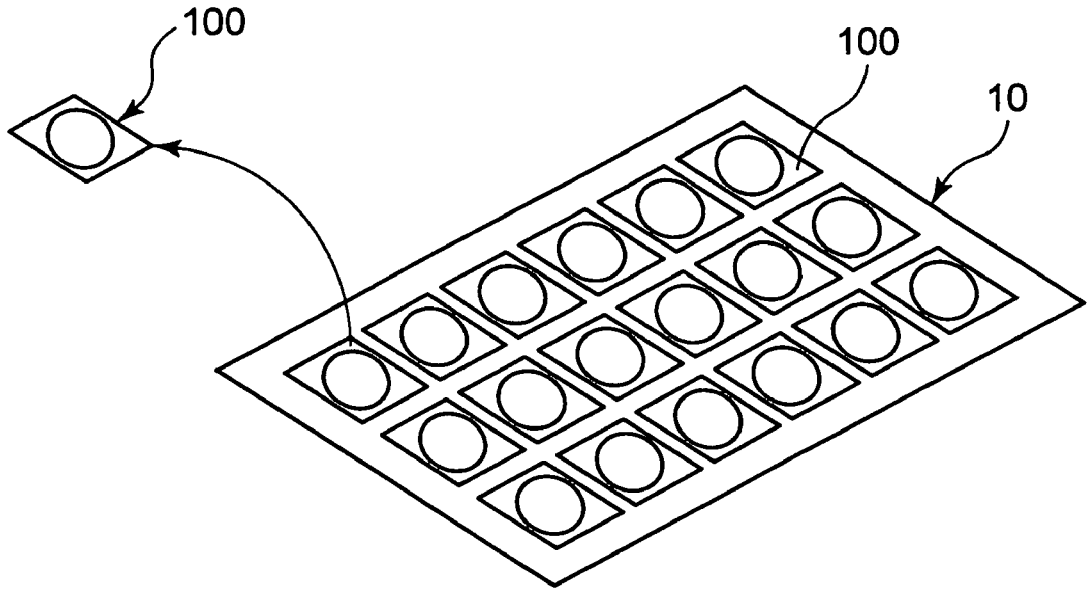
FIG. 5 shows a carrier sheet having the dome sheet unit according to an embodiment of the present invention.

FIG. 5 shows carrier sheet 10 that includes dome sheet units 100 according to an embodiment of the present invention.

As shown in FIG. 5, a plurality of dome sheet units 100 are aligned and pasted to carrier sheet 10 through stretching parts 122 of fixing sheets 120.

To form a membrane switch, dome sheet unit 100 is peeled off from the carrier sheet, pasted to board 4 and is arranged in a predetermined position above substrate 4, that is, in a position at a predetermined interval right above the fixed contact point on the pattern provided on board 4. By this means, it is possible to readily form a membrane switch.

Further, although, with the present embodiment, the shape of dome 110 is circular from a plan view, the present invention is not limited to this and any shape is possible as long as the shape is configured to be dented by elastic deformation when pressed from the projection side, and restore to the original state by releasing pressing.

Figure 6:
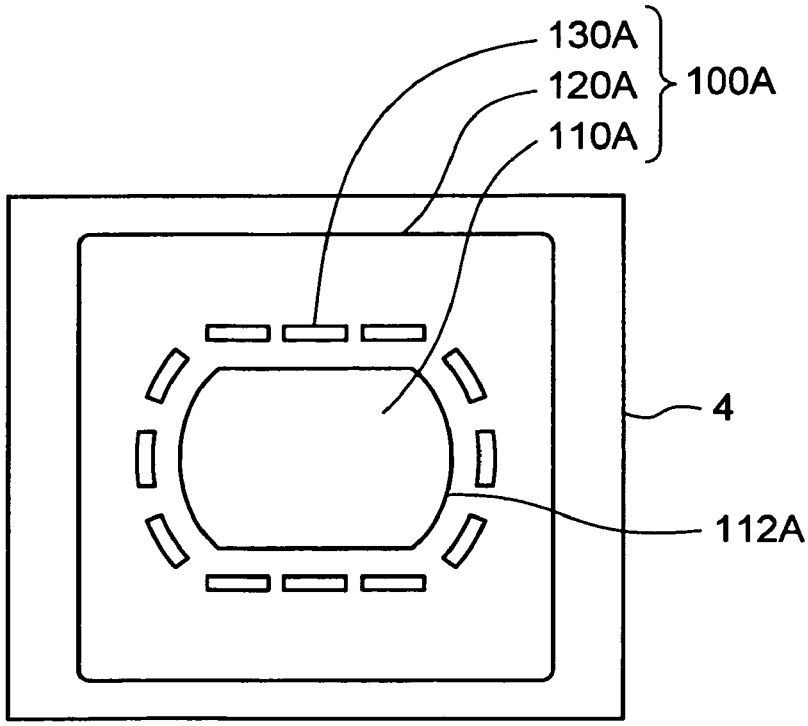
FIG. 6 shows modified example 1 of the dome sheet unit according to an embodiment of the present invention.
Figure 7:
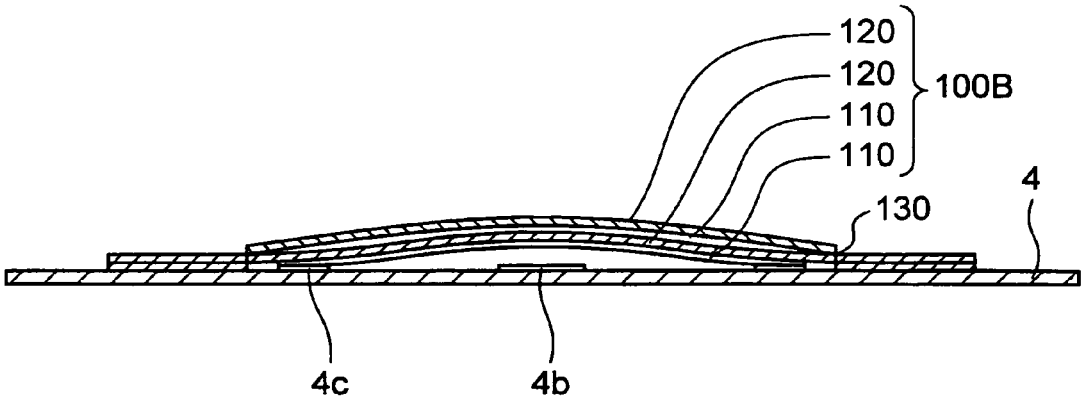
FIG. 7 is modified example 2 of the dome sheet unit according to an embodiment of the present invention.

FIG. 6 and FIG. 7 show modified examples of dome sheet units according to an embodiment of the present invention.

For example, similar to dome sheet unit 100A shown in FIG. 6, a configuration having dome 110*a* of an oval shape from a plan view is possible. In this case, in fixing sheet 120A covering dome 110A, a plurality of slits 130A are formed along outer rim 112A of oval dome 110A. In addition to the same function and operation as dome sheet unit 100, this dome sheet unit 100A can make the footprint with respect to board 4 smaller.

Further, similar to dome sheet unit 100B shown in FIG. 7, a configuration having two overlapping domes 110 and 110 is possible. Dome sheet unit 100B shown in FIG. 7 is configured by overlapping dome sheet units 100 and can improve the sense of click upon pressing dome 110, in addition to the same function and operation as above-described dome sheet unit 100.

Further, the above present invention can be variously modified without departing from the spirit of the present invention, and it naturally follows that the present invention covers such modifications.

Industrial Applicability

The dome sheet unit and membrane switch according to the present invention provides an advantage of attaching an elastically deformable dome to a board in a reliable manner such that the dome is not detached even if a fixing sheet is made thinner and smaller and therefore has a smaller footprint, and are useful in membrane switches.

The invention claimed is:

1. A dome sheet unit comprising:

a dome that in a regular state projects toward a surface and that is dented opposite toward a back face by elastic deformation; and a fixing sheet that is flexible, that has a back face of an adhesive face pasted to an entire surface of the surface of the dome and that fixes the dome in a predetermined position by means of a stretching part which stretches radially outwardly from the dome, from an outer rim of the dome, in a direction substantially orthogonal to a direction in which the dome projects, wherein a plurality of cut parts are formed in the fixing sheet at predetermined intervals along the outer rim of the dome to form a broken line mirroring contours of the dome, wherein the plurality of cut parts prevent the stretching part in the fixing sheet from joining with a part above the dome which continues in a radial direction of the dome.

2. The dome sheet unit according to claim 1, wherein the cut part comprises a slit that is provided along the outer rim of the dome.

3. A membrane switch comprising:

the dome sheet unit according to claim 1; and a board mounting a fixed contact point on a surface of the board, wherein the dome sheet unit is attached to the board by positioning the dome in a position opposing to the contact point, and by pasting the stretching part to a part in the surface of the board surrounding the dome, and wherein the plurality of cut parts formed in the fixing sheet do not overlap a second plurality of cut parts formed in the board.

* * * * *